US006007929A

United States Patent [19]

Robertson et al.

[11] Patent Number: 6,007,929

[45] Date of Patent: Dec. 28, 1999

[54] DUAL PAINT COAT LASER-MARKING LABELING SYSTEM, METHOD AND PRODUCT

[75] Inventors: John A. Robertson, Chillicothe; Edward S. O'Neal, Rockbridge, both of Ohio

[73] Assignee: Infosight Corporation, Chillicothe, Ohio

[21] Appl. No.: 08/803,077

[22] Filed: Feb. 20, 1997

[51] Int. Cl.[6] ..... B27N 9/00

[52] U.S. Cl. ..... 428/913; 428/195; 428/204; 428/352; 428/914; 428/915; 283/101; 283/103; 283/105; 430/945; 427/533; 427/551; 427/553; 427/554; 427/595

[58] Field of Search ..... 428/192, 195, 428/411.1, 204, 913, 914, 352, 915; 283/101, 103, 105; 430/945; 427/533, 551, 553, 554, 595

[56] References Cited

U.S. PATENT DOCUMENTS 5,340,628 8/1994 McKillip ..... 428/40

5,626,966 5/1997 Kiilper et al. ..... 428/423.1

*Primary Examiner*—Merrick Dixon

*Attorney, Agent, or Firm*—Mueller and Smith, LPA

[57] ABSTRACT

The present invention is directed to a system for marking objects for their identification. The inventive system includes a laser that emits a select band of radiation and a coating system for application to an object or workpiece to be marked. The coating system is composed of two contrasting coats of paint, a topcoat and a basecoat, which have been coated sequentially on the workpiece. The topcoat, while still wet, can be ablated by the beam of said laser while the basecoat, while wet, dry or tacky, is refractory to the beam of said laser. The laser, thus, can generate alphanumeric and graphic characters (product identification indicia) on the workpiece by its beam being directed onto the coating system for ablating the topcoat to reveal the basecoat to generate the characters by dint of the visible contrast between the two coats of paint.

20 Claims, 3 Drawing Sheets

DUAL PAINT COAT LASER-MARKING LABELING SYSTEM, METHOD AND PRODUCT

CROSS-REFERENCE TO RELATED APPLICATIONS

This application is cross-referenced to commonly-assigned application Ser. No. 08/661,063, filed on Jun. 10, 1996, entitled "$CO_2$ Laser Marking of Coated Surfaces for Product Identification", the disclosure of which is expressly incorporated herein by reference.

STATEMENT REGARDING FEDERALLY SPONSORED RESEARCH

Not applicable.

BACKGROUND OF THE INVENTION

The present invention relates to the marking of product for tracking and identification (eg., information purposes) and more particularly to using laser marked dual-coated product zones therefor.

There is a need to identify products with high quality bar codes and human-readable information without the use of an adhesive label. For example, welded tubular goods manufacturers (e.g., manufacturers of oil and gas pipeline pipe) desire to identify their products with human-readable data (e.g., heat chemistry of the source plate, pressure testing results, American Petroleum Institute (AIP) code conformation, etc.), as well as automatic identification (e.g., bar codes) for traceability and handling efficiency.

Paper labels often are unsuitable (as is the case in the aforementioned tubular goods) because they can peel off (e.g., contaminate the pipeline) and they may not be suitable for the environment (e.g., application to hot/wet/oily surfaces or pipes which will be exposed to high temperatures during subsequent coating operations). Bar codes and, to a lesser degree, the human-readable characters, require high contrast markings on products which have a wide range of background reflectivity (e.g., shiny to dull black pipe).

Heretofore, Nierenberg (U.S. Pat. No. 4,323,755) vaporizes a pattern (bar code) on glass CRTs for their identification. To improve contrast, the vaporized area can be coated first. Williams (U.S. Pat. No. 5,206,280) discloses a laser markable white pigment composition. Shimokawa (U.S. Pat. No. 4,847,181) proposes a dual layer label that can be laser marked. Gnanamuthu (U.S. Pat. No. 4,716,270) proposes a laser marking system where substrate is etched following laser marking of a label. Norris (U.S. Pat. No. 5,262,613) retrofits a mechanical engraver with a laser. Snakenborg (U.S. Pat. No. 4,946,763) proposes form a pattern in a metal stencil which is covered by a resist material containing a high concentration of metal powder. Resist material is removed by a laser beam to form the pattern. Honaker (U.S. Pat. No. 4,935,288) proposes a laser printable label having a coating of laser printable acrylic. Kiyonari (U.S. Pat. No. 5,063,137) proposes a resin composition for laser marking having an inorganic compound, like an anhydrous metal borate salt, and a resin. Kiyonari (U.S. Pat No. 5,035,983) proposes a laser marking composition containing a non-black inorganic lead compound. Azuma (U.S. Pat. No. 4,861,620) proposes a pigment layer which can be marked by a laser beam. Herren (U.S. Pat. No. 5,030,551) laser marks ceramic materials coated with a transparent layer of titanium dioxide. Gernier (U.S. Pat. No. 4,985,780) proposes a two carriage assembly for laser marking articles. Robertson (U.S. Pat. No. 5,422,167) proposes a thermally-printable, high temperature-resistant coating for marking hot bands and like metal products.

Additionally, a variety of other raw and finished goods (e.g., automobile mechanical parts, tires, etc.) require marking for identification or information purposes. Such goods may be at or below room temperature when the marking requirement arises. A system that has the flexibility to mark "hot" metal as well as lower temperature items would be welcome.

BRIEF SUMMARY OF THE INVENTION

The present invention is directed to a system for marking objects for their identification. The inventive system includes a laser that emits a select band of radiation and a coating system for application to an object or workpiece to be marked. The coating system is composed of two contrasting coats of paint, a topcoat and a basecoat, which have been coated sequentially on the workpiece. The topcoat, while still wet or tacky, can be ablated by the beam of said laser while the basecoat, while wet, dry, or tacky, is refractory to the beam of said laser. The laser, thus, can generate alphanumeric and graphic characters (product identification indicia) on the workpiece by its beam being directed onto the coating system for ablating the topcoat to reveal the basecoat to generate the characters by dint of the visible contrast between the two coats of paint.

The corresponding method includes the steps of coating a workpiece to be marked with two contrasting coats of paint, a topcoat and a basecoat, which have been coated sequentially on the workpiece. While preferably both of the coats of paint still are wet, the laser beam generates alphanumeric and graphic characters on the workpiece by its beam being directed onto the coating system for ablating the topcoat to reveal the basecoat to generate the characters by dint of the visible contrast between the two coats of paint.

The resulting label formed by visibly contrasting upper and lower coats of paint on a workpiece displays alphanumeric and/or graphic characters formed by a topcoat of paint which has been ablated by a laser beam while still wet or tacky, the characters being formed by the basecoat of paint (which preferably is wet or tacky, though it can be dry) which is relatively refractory to ablation by the laser beam.

Advantages of the present invention include the ability to rapidly mark virtually any configuration of workpiece, including curved or irregular as well as flat surfaces. Another advantage is the ability to mark both hot and cold surfaces. Yet another advantage is the ability to mark dirty and/or oily surfaces. A further advantage is the ability to mark workpieces on the factory floor with both human readable and machine readable characters. Yet a further advantage is the ability to apply both coats of paint and discharge the laser from a single head. These and other advantages will be readily apparent to those skilled in the art based on the disclosure herein.

The drawings will be described in detail below.

DETAILED DESCRIPTION OF THE INVENTION

Figure 2:
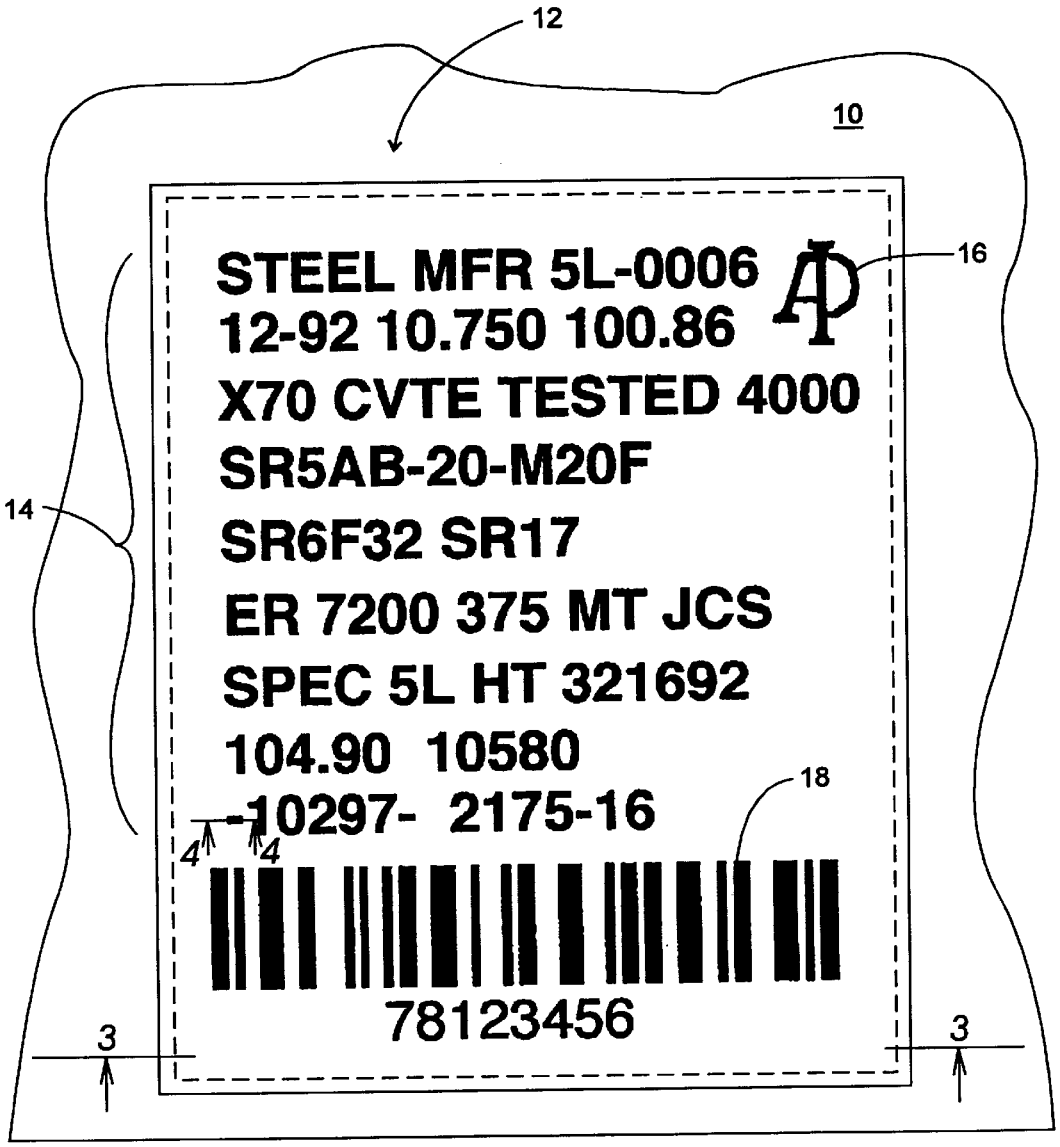
FIG. 2 is a sectional view taken along line 2—2 of FIG. 1.

Referring initially to FIG. 2, pipe inside is shown to bear the inventive "painted" label generally at 12. This painted label may, in the case of large diameter pipe, typically be about 4"×6" and is shown to contain human readable alphanumeric characters, as at 14; a logo (graphics) 16, and bar code 18. Obviously, printing this much data and graphics requires a high resolution printing technique. Nevertheless, such information can be quite valuable to the manufacturer as well as to the user of the pipe whether the information is to be read by a person or automatically, e.g., by a bar code scanner.

Figure 3:
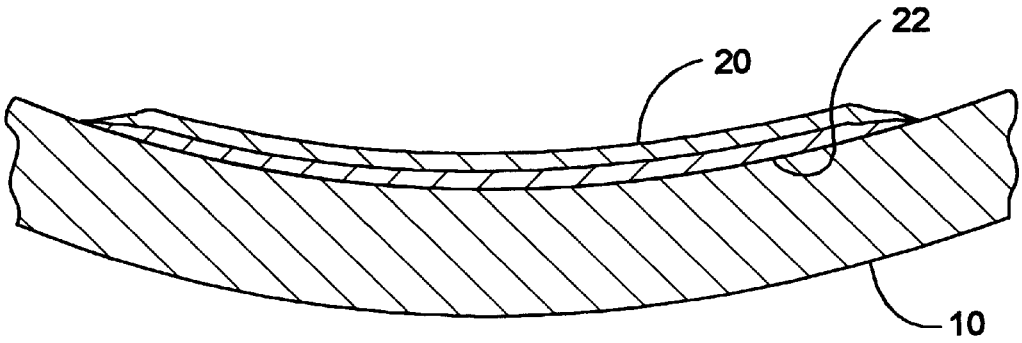
FIG. 3 is a sectional view taken along line 3—3 of FIG. 2.

Referring to FIG. 3, the dual paint coats portion of the inventive marking system is shown applied to the inside of pipe 10 and is composed of topcoat or upper coat 20 and basecoat or lower coat 22. Desirably, these coats exhibit a maximum visible contrast, such as black basecoat 22 and white topcoat 20, to enhance alphanumeric characters 14, graphics 16, and picket fence bar code 18 (see FIG. 2), which are created by topcoat 20 being ablated to reveal basecoat 22. Obviously, while black and white coatings provide the optimum contrast, other color pairs can be used provided that they are matched to the frequency of the laser beam (as will be described further below). Such dual coating technique provides readily readable (both human and machine) characters regardless of the color of the workpiece being labeled. Thus, the workpiece can be any color and its surface exhibit virtually any gloss, and the inventive labeling system provide the same high quality and consistently readable labels. Moreover, with the proper formulation of paints, the surface of pipe 10 does not have to be totally cleaned before application of the paint coatings. Also, the temperature of the workpiece can vary greatly and properly formulated paints still adhere thereto.

Figure 4:
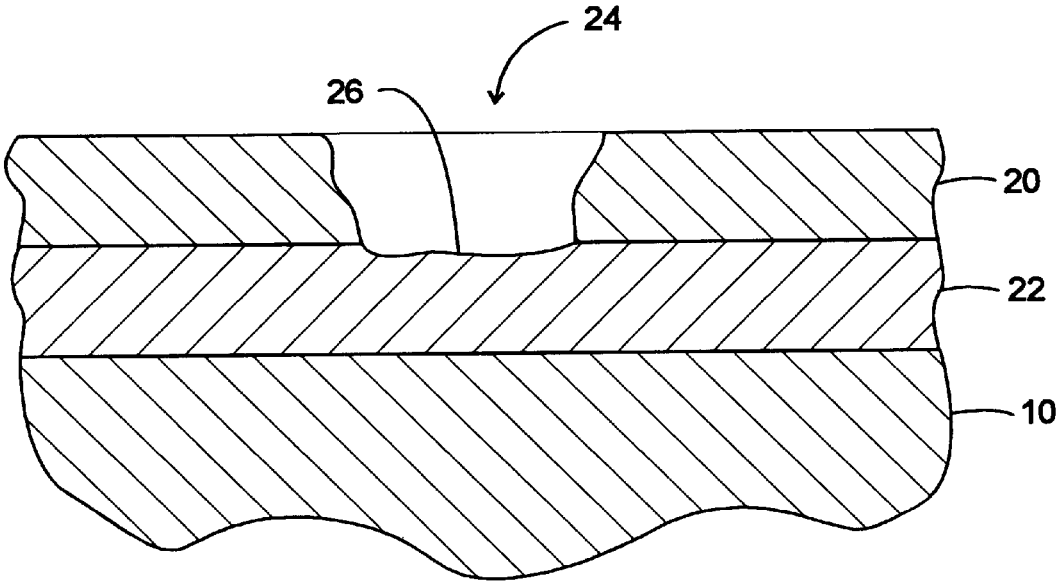
FIG. 4 is a sectional view taken along line 4—4 of FIG. 2.

Referring to FIG. 4, one of the characters on label 12 is revealed in detail. It will be observed that a portion of topcoat 20 has been ablated to yield cavity 24 which reveals area 26 of basecoat 22. By controlling the size and shape of cavity 24, virtually any alphanumeric character and graphic can be created. Note, also, that most of basecoat 22 remains intact, thus ensuring the desired color contrast between area 26 and topcoat 20.

Figure 1:
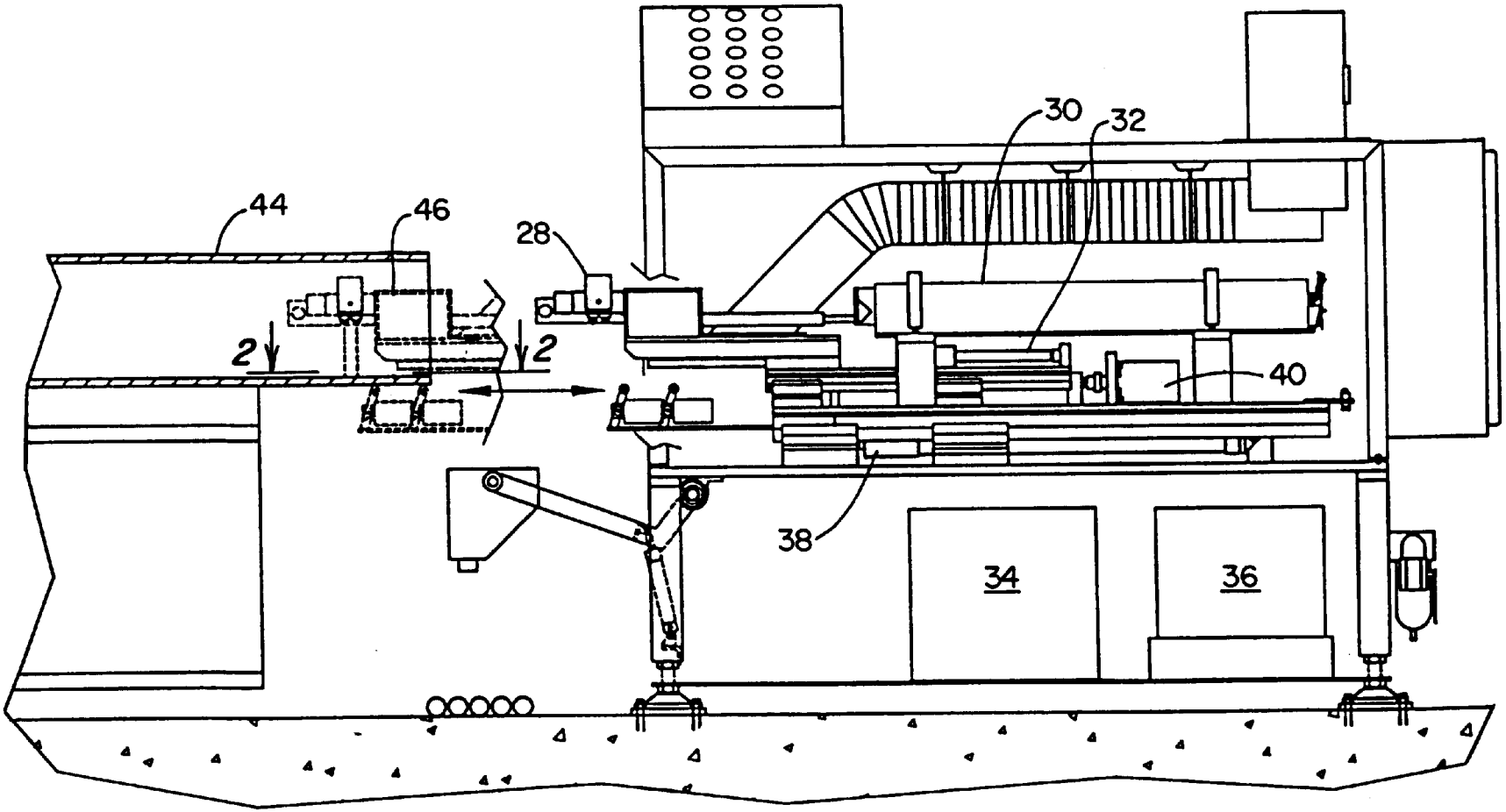
FIG. 1 is a general arrangement schematic of a prototype marking apparatus adapted to produce a "painted" label on the inside of a pipe.

Referring to FIG. 1, depicted is a general arrangement schematic of a prototype marking apparatus adapted to produce a "painted" label on the inside of a pipe. This prototype is seen to be composed of moveable head 28 which contains two air nebulized paint spray nozzles, a dry air nozzle, and a laser focusing system (composed of a galvanometer or galvo mirror, focusing lens, and galvanometer or galvo, such as is described in application Ser. No. 08/661,063). Head 18 is connected to laser 30, a pair of nozzle extension cylinders with only paint cylinder 32 depicted, and purge air dryer 34. Associated equipment includes laser heat exchanger 36, main slide cylinder 38, laser stepper motor 40, and control panel 42. Additional lines, connections, exhaust fans and ducts, etc. are provided in conventional fashion.

In operation moveable head 28 is extended by main slide cylinder 38 to a position within pipe 44 as shown in phantom at 46. The two paint coats then are sequentially applied followed rapidly by laser initiation to generate the label characters and graphics. Head 28 then is retracted from within pipe 44 to complete the operation. Another pipe then can be stationed confronting head 28 and the process repeated.

Of importance is that at best the top, and preferably both, paint coats are wet or tacky, i.e., still contain solvent or vehicle, when the laser beam impinges upon the topcoat. The focused laser beam is capable of vaporizing topcoat 20 to start forming cavity 24 and continue to vaporize material in topcoat 20 until lower or basecoat 22 is reached. The boiling ablation of material from basecoat 22 (if present) carries away any residual topcoat pigments and other solids left from the topcoat ablation and aids in exposing a fresh, high contrast, basecoat at area 26. The ablation of topcoat 20 is enhanced if it contains residual solvent(s) which in effect boil violently and carry away a slug of material forming topcoat 20. Pigments and binders used in formulating basecoat 22 are chosen so that, once dry by the action of the laser, the dry basecoat is relatively unaffected (i.e., is not ablated) further by the laser beam (e.g., organic binders that reflect the laser beam). This "stops" the marking action of the laser beam and ensures that pipe 10 remains protected and unexposed to the laser beam.

While basecoat 22 preferably is wet or tacky (i.e., contains residual fugitive solvent) when topcoat 20 is applied and the laser marking action commenced, a novel label can be generated when basecoat 22 has been dried before coating and/or laser marking has commenced. (Note: topcoat 20 is wet or tacky as evidenced by it containing residual solvent at the time laser marking commences regardless of whether basecoat 22 is wet, tacky, or dry.) On some occasions, partially drying basecoat 22 to where it contains only small amounts of residual solvent may enhance its resistance to being ablated by the laser. For present purposes, a "refractory" basecoat is one that substantially resists being ablated by the laser so that a visible paint coat remains after the topcoat has been ablated. The paint coats of the present invention are for labeling purposes and are not necessarily designed to provide protection to the substrate or workpiece to which they are applied, although the paint coats may be formulated to also achieve a degree of protection to the substrate or workpiece. For practical one-station production-rate marking, it is desired that topcoat 20 be applied over basecoat 22 within about 10 seconds after application of basecoat 22 for paint systems as tabulated above.

Laser 30 preferably is a $CO_2$ laser because sealed units with long (>10,000 operating hours) lives are available commercially. While use of conventional dual axis scanning lasers fitted with two mirrors and galvanometers (so-called X-Y galvo systems) can be practiced, the laser beam preferably is scanned in one direction only (Y-axis or Y direction) while the relative motion of the surface to be marked and/or the laser optics provides X-axis or X direction effective movement of the surface to be marked. Scanning in one direction only greatly reduces the cost of the galvanometer system compared to an X/Y two galvanometer plus flat field lens system which can position a focused beam over a relatively large area. Raster scanning, although slower for typical patterns, also permits the marking of long objects (such as, for example, large bar code tags) without error prone jogging and splicing within the marked image (bar code). The speed of the X direction (stepping) can be accelerated over blank areas (areas not to be marked) to increase the overall speed of the marking cycle. The scanning angle, Y scanning, also can be varied as is appropriate for the marked height which also increases the overall speed of the laser scan. Details on such raster scanning laser beams can be found in application Ser. No. 08/661,063.

While the use of a $CO_2$ laser to mark a white topcoat and black basecoat coating system is preferred. It will be appreciated that other laser (reader) scanning systems, e.g., helium-neon laser bar code reader, requires a high reflectivity ratio to red visible light, whereby a red-green coating system would be practical. Thus, the marking laser is selected, as is the colors of the dual paint coats, so that the topcoat is ablated by the laser beam while the basecoat remains relatively immune or refractory to the action of the laser beam. Appropriate contrast for the reader between the two paint coats completes the system including, for example, for bar codes to be scanned by laser scanning systems, or for human reading.

Topcoat 20 and basecoat 22 are formulated from ingredients that permit them to remain as ostensibly separate layers after application. Thus, the density of topcoat 20 should be less than the density of basecoat 22, the solvents of the two coats are relatively immiscible, or the surface energy of basecoat 22 is such that basecoat 22 supports topcoat 20 without any appreciable mixing, or the like, or a combination thereof. Those skilled in paint formulating will be able to readily compound topcoats and basecoat formulations for use in accordance with the precepts of the present invention. For example, the following formulations have been successfully tested:

| INGREDIENT | BASECOAT (weight-%) | TOPCOAT (weight-%) |
|---|---|---|
| Carbon Black Pigment | 18.2 | — |
| $TiO_2$ Pigment | — | 27.2 |
| Ethyl Alcohol | 18.2 | 18.2 |
| Ethyl Acetate Ester | 18.2 | 13.65 |
| 1-Methyl-2-Propanol | 13.65 | 13.65 |
| Toluene | 13.65 | 9.1 |
| 2-Butanone | 4.55 | 4.55 |
| Isopropanol | 4.55 | 4.55 |
| Nitrocellulose (binder) | 9 | 9 |

The black basecoat was applied at 0.5 to 8 mils in thickness while the white topcoat was applied at 0.5 to 8 mils in thickness directly atop the wet or tacky basecoat. The dual paint coats were immediately marked with a focused 50 watt $CO_2$ laser beam (e.g., a 50 watt, 10.6$\mu$ infrared unit, Synrad Inc., Bothell, Wash.) at about 1.5 square inch/second. The paint itself is dry and hard within about 3 minutes. On the inside of a pipe, the marking is protected as it dries. On the outside of a pipe or other workpiece, hot air-assisted drying after marking may be desirable. The pipe or other workpiece can be heated or otherwise processed, for example, epoxy coating process temperatures of up to about 500° F. (260° C.) for about 10 minutes, without deleterious affecting the laser marked label described above.

Markings of line widths of down to 0.006 inches (0.15 mm) has been achieved. This means that the smallest "x" dimensions (narrowest line or space) must be larger than 0.006 inches. Robust codes should utilize bars which are (near integer) multiples of this line width.

Workpieces to be labeled in accordance with the present invention can be composed of metal, wood, plastic (optionally fiber reinforced), composite, ceramic, glass, or any other substance capable of being coated. Of course, substrates sensitive to the heat generated by the laser may find limited utility in the practice of the present invention. Workpieces can be rigid or flexible, of any geometry (flat or curvilinear), and oriented horizontally, vertically, or canted an angle, and still find use in the practice of the present invention. The present invention is especially adapted to mark or label strapping (or banding) material prior to of after use, grained surfaces such as castings where traditional labels do not adhere well, and the edge of steel plate where labels will not adhere to a sheared edge.

While the invention has been described and illustrated in connection with certain preferred embodiments thereof, it will be apparent to those skilled in the art that the invention is not limited thereto. Accordingly, it is intended that the appended claims cover all modifications which are within the spirit and scope of this invention. All references cited herein are expressly incorporated herein by reference.

We claim:

1. A system for marking workpieces for their identification, which comprises:

(a) a laser that emits a beam select band of radiation;

(b) a coating system for application to a workpiece to be marked, said coating system comprising two contrasting coats of paint, a topcoat and a basecoat, which paints have been coated sequentially on said workpiece, the topcoat being applied over said basecoat when said basecoat is wet, tacky, or dry, while said topcoat still is wet or tacky it is ablated by the beam of said laser, the basecoat is refractory to the beam of said laser, whereby the laser can generate product identification indicia on said workpiece by its beam being directed onto said coating system for ablating said topcoat to reveal said basecoat to generate said characters by dint of the visible contrast between said two coats of paint.

2. The system of claim 1, wherein said basecoat and said topcoat are of a contrast effective to make said product indicia humanly or machine readable.

3. The system of claim 2, wherein said basecoat is black in color and said topcoat is white in color.

4. The system of claim 1, wherein said laser is a $CO_2$ laser.

5. The system of claim 3, wherein said $CO_2$ laser is a raster-scanning infrared laser beam emitting $CO_2$ laser that raster-scans in the Y-axis; and said workpiece is moved in the X-axis for said laser beam to form said product identification indicia.

6. The system of claim 1, wherein said product identification indicia includes one or more of human readable and machine readable information formed from one or more of alphanumeric characters and graphic characters.

7. The system of claim 1, wherein said topcoat is applied over said basecoat while said basecoat contains residual solvent.

8. The system of claim 1, wherein said laser is connected to a pair of galvanometer or stepper motor driven minor systems so as to scan in both the X-axis and the Y-axis.

9. A method for marking workpieces for their identification, which comprises the steps of:

(a) providing a laser that emits a beam select band of radiation;

(b) coating said workpiece with a coat of a basecoat which while wet is refractory to the beam of said laser;

(c) overcoating said basecoat while still wet or tacky with a coat of a topcoat, said topcoat being contrasting in color with said basecoat; and (d) while said topcoat still is wet or tacky, contacting said wet topcoat with said laser beam to ablate said topcoat to form product identification indicia thereon, said topcoat revealing said basecoat to generate said indicia by dint of the visible contrast between said two coats of paint.

10. The method of claim 9, wherein said basecoat coated in step (b) and said topcoat overcoated in step (c) are of a contrast effective to make said product indicia humanly or machine readable.

11. The method of claim 10, wherein said basecoat is provided to be black in color and said topcoat is provided to be white in color.

12. The method of claim 9, wherein said laser provided is a $CO_2$ laser.

13. The method of claim 12, wherein said $CO_2$ laser is a raster-scanning infrared laser beam emitting $CO_2$ laser that is raster-scanned in the Y-axis; and said workpiece is moved in the X-axis for said laser beam to form said product identification indicia.

14. The method of claim 9, wherein said product identification indicia formed in step (d) includes one or more of human readable and machine readable information formed from one or more of alphanumeric characters and graphic characters.

15. The method of claim 9, wherein the workpiece is a pipe which is coated on its inside diameter in steps (b) and (c).

16. The method of claim 9, wherein said laser in step (d) is connected to a pair of galvanometer or stepper motor-driven mirror systems so as to scan in both the X-axis and the Y-axis.

17. A label bearing product identification indicia, which comprises:

a basecoat overcoated with a topcoat which is contrasting in color with said basecoat; said topcoat being applied over said basecoat while said basecoat is wet, tacky, or dry; said basecoat being refractory to a laser beam; said topcoat having been ablated while still wet by a laser beam to form product identification indicia by dint of the visible contrast between said two coats of paint.

18. The label of claim 17, wherein said basecoat and said topcoat are of a contrast effective to make said product indicia humanly or machine readable.

19. The label of claim 17, wherein said basecoat is black in color and said topcoat is white in color.

20. The label of claim 17, wherein said product identification indicia includes one or more of human readable and machine readable information formed from one or more of alphanumeric characters and graphic characters.

* * * * *